US012435576B2

(12) United States Patent
Liu et al.

(10) Patent No.: US 12,435,576 B2
(45) Date of Patent: Oct. 7, 2025

(54) MULTI-CUTTING-EDGE DIAMOND COMPOSITES AND EARTH-BORING TOOLS

(71) Applicants: KINGDREAM PUBLIC LIMITED COMPANY, Wuhan (CN); SINOPEC OILFIELD EQUIPMENT CORPORATION, Wuhan (CN)

(72) Inventors: Qiang Liu, Wuhan (CN); Guanfu Tu, Wuhan (CN)

(73) Assignees: Kingdream Public Ltd. Co., Wuhan (CN); Sinopec Oilfield Equipment Corporation, Wuhan (CN)

( * ) Notice: Subject to any disclaimer, the term of this patent is extended or adjusted under 35 U.S.C. 154(b) by 0 days.

(21) Appl. No.: 18/569,964

(22) PCT Filed: Mar. 3, 2023

(86) PCT No.: PCT/CN2023/079500

§ 371 (c)(1),
(2) Date: Dec. 13, 2023

(87) PCT Pub. No.: WO2023/165592

PCT Pub. Date: Sep. 7, 2023

(65) Prior Publication Data

US 2025/0092741 A1 Mar. 20, 2025

(30) Foreign Application Priority Data

Mar. 3, 2022 (CN) ..... 202210218326.6

(51) Int. Cl.
*E21B 10/567* (2006.01)

(52) U.S. Cl.
CPC ..... *E21B 10/567* (2013.01)

(58) Field of Classification Search
CPC ..... E21B 10/56; E21B 10/567; E21B 10/55; E21B 10/52; E21B 10/46
See application file for complete search history.

(56) References Cited

U.S. PATENT DOCUMENTS

2019/0040689 A1* 2/2019 Liang ..... E21B 10/5673
2019/0210931 A1 7/2019 Wang et al.

FOREIGN PATENT DOCUMENTS

CN 208203141 12/2018
CN 209687419 11/2019
(Continued)

OTHER PUBLICATIONS

Wan et al., Chinese Pat. No. CN213953520U, Aug. 3, 2021. English translation date 2024. (Year: 2021).*
(Continued)

*Primary Examiner* — Caroline N Butcher
(74) *Attorney, Agent, or Firm* — Fish & Richardson P.C.

(57) ABSTRACT

A multi-cutting-edge diamond composite includes a columnar hard alloy substrate and a diamond composite layer, the diamond composite layer being disposed at a top end of the hard alloy substrate, wherein a circumferential edge of a top end of the diamond composite layer is provided with at least two segments of different chamfers to form different cutting edges. By providing different chamfers on the circumferential edge of the top end of the diamond composite layer, multiple cutting edges are formed in the circumferential direction of an end face of the diamond composite, such that different edges of the same composite sheet have different attacking abilities and impact resistance abilities. Since the chamfers form various cutting edges with different properties, the same diamond composite can meet the requirement of drilling in different strata, and can enable a diamond drill bit to adapt to the requirement of drilling in complex strata.

13 Claims, 7 Drawing Sheets

(56) References Cited

FOREIGN PATENT DOCUMENTS

| | | | |
|---|---|---|---|
| CN | 213330910 | | 6/2021 |
| CN | 213953520 | | 8/2021 |
| CN | 213953520 U | * | 8/2021 |
| CN | 213980659 U | * | 8/2021 |
| CN | 216841452 | | 6/2022 |
| CN | 114753772 | | 7/2022 |

OTHER PUBLICATIONS

Tu et al., Chinese Pat. No. CN213980659 U, Aug. 17, 2021. English translation date 2024. (Year: 2021).*

International Search Report and Written Opinion in International Appln. No. PCT/CN2023/079500, mailed on May 19, 2023, 10 pages (with Partial English Translation).

International Preliminary Report on Patentability in International Appln. No. PCT/CN2023/079500, mailed on Sep. 12, 2024, 11 pages (with English translation).

* cited by examiner

MULTI-CUTTING-EDGE DIAMOND COMPOSITES AND EARTH-BORING TOOLS

CROSS-REFERENCE TO RELATED APPLICATIONS

This disclosure claims priority to Chinese Patent Application 202210218326.6, filed on Mar. 3, 2022, entitled "Multi-Cutting-Edge Diamond Composites", which is hereby incorporated by reference in its entirety.

FIELD OF THE INVENTION

The present disclosure relates to a multi-cutting-edge diamond composite serving as a cutting element of a diamond drill bit, belonging to the technical field of oil drilling tools.

BACKGROUND OF THE INVENTION

Diamond drill bits have been widely used in oil and gas drilling engineering since the 1880s. A diamond drill bit is mainly composed of a bit body and cutting elements. Diamond drill bits are classified into three categories according to cutting elements: PDC (polycrystalline diamond compact) drill bits, TSP (thermally stable polycrystalline diamond) drill bits, and natural diamond drill bits. PDC drill bits are mainly used for drilling in soft to medium-hard formations. With continuous technological progress, PDC drill bits have an increasingly wide scope of application and good economic value. TSP drill bits are mainly used for drilling in medium-hard to very-hard formations. At present, deep well operations are increasing progressively in oil and gas drilling engineering, and strata encountered by drilling are more and more complex.

A diamond composite is composed of a columnar hard alloy substrate and a diamond composite layer. Chamfers on a circumferential edge of a top end of the diamond composite layer form cutting edges of the composite sheet. During drilling by a diamond drill bit, strata encountered by drilling in different regions are not same, and require different attacking and impact-resistance abilities of the composite sheet. However, chamfers of cutting edges of existing composite sheets are unitary, making it difficult to adapt to the requirement of drilling in complex stratum.

SUMMARY OF THE INVENTION

In order to adapt to the requirement of drilling in different strata, the present disclosure provides a multi-cutting-edge diamond composite including a columnar hard alloy substrate and a diamond composite layer, the diamond composite layer being disposed at a top end of the hard alloy substrate, wherein a circumferential edge of a top end of the diamond composite layer is provided with at least two segments of different chamfers to form different cutting edges.

In some embodiments of the present disclosure, the circumferential edge of the top end of the diamond composite layer is provided with 2 to 4 segments of different chamfers to form 2 to 4 segments of different cutting edges.

In some embodiments of the present disclosure, the chamfers include at least one of the following types: single-bevel chamfer, double-bevel chamfer, or curved chamfer.

In some embodiments of the present disclosure, two segments of different chamfers satisfy one of the following conditions: different types; and a same type but with different structural parameters.

In some embodiments of the present disclosure, a bevel face of each chamfer is inclined relative to a radial plane of the diamond composite layer at an angle in the range from 20° to 70°, and a top end face of the diamond composite layer is perpendicular to an axis of the columnar hard alloy substrate.

In some embodiments of the present disclosure, each chamfer has a radial width of 0.2 to 5 mm.

In some embodiments of the present disclosure, the greater the radial width of the chamfer, the smaller an included angle between the bevel face of the chamfer and the radial plane of the diamond composite layer. In some embodiments of the present disclosure, the top end face of the diamond composite layer is planar, inwardly concave or outwardly convex.

In some embodiments of the present disclosure, a transverse cross-section of the diamond composite layer is same as that of the hard alloy substrate, both being circular, elliptical, or regular polygonal.

In some embodiments of the present disclosure, the diamond composite layer is a polycrystalline diamond composite layer or a thermally stable polycrystalline diamond composite layer.

In some embodiments of the present disclosure, the entire circumferential edge of the top end of the diamond composite layer is provided with chamfers.

In some embodiments of the present disclosure, the circumferential edge of the top end of the diamond composite layer is divided into 4 segments of different chamfers, wherein 2 chamfers that are spaced apart have same central angles.

In some embodiments of the present disclosure, the central angles are 52° and 128°, or 90°.

In some embodiments of the present disclosure, the circumferential edge of the top end of the diamond composite layer is divided into 3 segments of different chamfers, and central angles of the 3 chamfers are from 120°.

The present disclosure also provides an earth-boring tool including a multi-cutting-edge diamond composite.

The present disclosure provides at least one of the following beneficial effects:

By providing different chamfers on the circumferential edge of the top end of the diamond composite layer, multiple cutting edges are formed in the circumferential direction of the top end face of the diamond composite, such that different edges of the same composite sheet have different attacking abilities and impact resistance abilities.

Since the chamfers on the circumferential edge of the top end of the diamond composite layer form various cutting edges with different properties of the composite sheet, the same diamond composite can meet the requirement of drilling in different strata, and when reasonably arranged on a diamond drill bit, can enable the diamond drill bit to adapt to the requirement of drilling in complex strata.

DETAILED DESCRIPTION OF THE EMBODIMENTS

Technical solutions in the embodiments of the present disclosure will be described below clearly and completely in conjunction with the accompanying drawings in the embodiments of the present disclosure. Obviously, the described embodiments are only part of, instead of all, of the embodiments of the present disclosure. The following description of at least one exemplary embodiment is actually only illustrative, and in no way serves as any limitation on the present disclosure and its application or use. Based on the embodiments in the present disclosure, other embodiments obtained by those of ordinary skill in the art without creative work should fall into the protection scope of the present disclosure.

Figure 1:
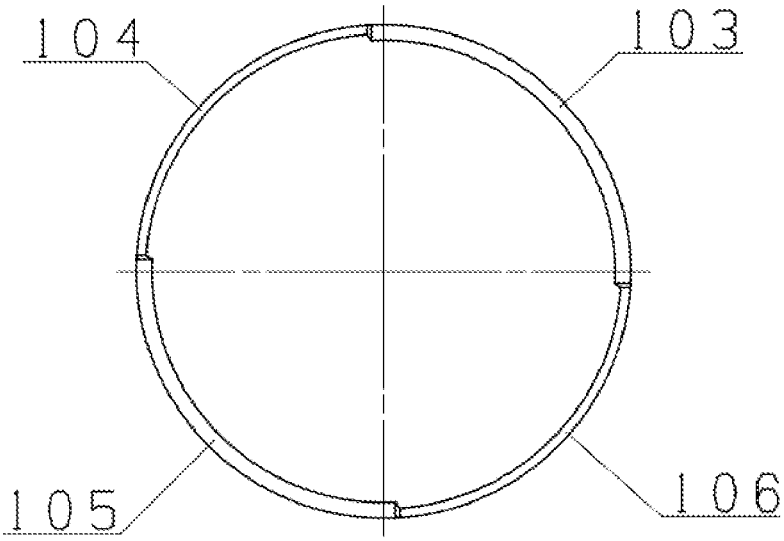
FIGS. 1 and 2 are a top view and a front view, respectively, of embodiment I of the present disclosure.
Figure 2:
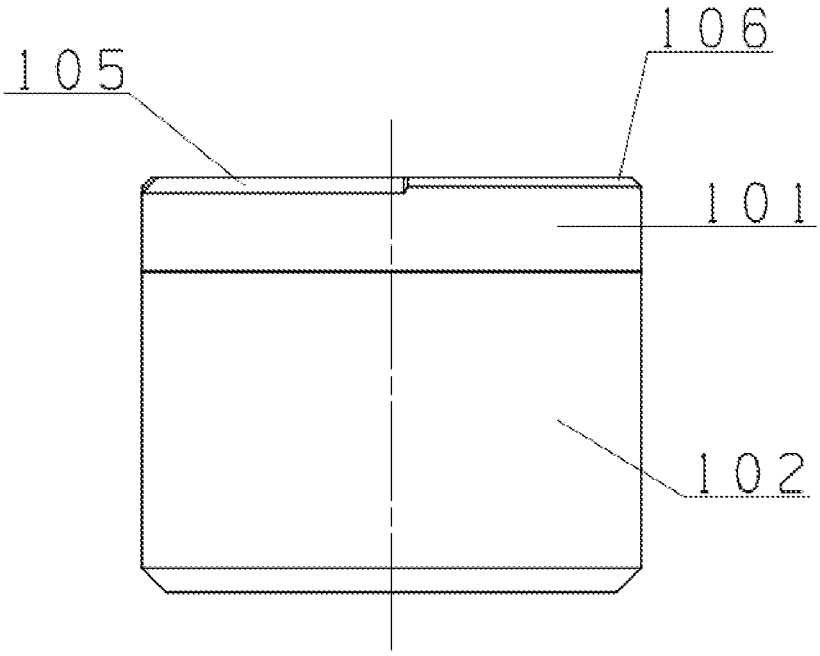

In embodiment I, as shown in FIGS. 1 to 2, a multi-cutting-edge diamond composite includes a diamond composite layer 101 and a hard alloy substrate 102. A top end face of the diamond composite layer is planar, and the diamond composite layer is a polycrystalline diamond composite layer. The diamond composite layer and the hard alloy substrate are integrated into a whole by ultra-high-temperature and high-pressure sintering. A circumferential edge of a top end of the diamond composite layer is provided with 4 segments of chamfers 103, 104, 105, 106, each segment of chamfer corresponding to a central angle of 90°. The 4 segments of chamfers may include two, three or four kinds of different chamfers, wherein the 2 segments of chamfers 103, 105 are same, 45° single-bevel chamfers with a radial width of 0.4 mm and are spaced 90° apart and in symmetrical distribution, the other 2 segments of chamfers 104, 106 are same, 45° single-bevel chamfers with a radial width of 0.3 mm. The chamfers are arranged circumferentially and connected end to end, that is to say, the chamfers are disposed on the entire circumferential edge of the diamond composite layer 101, with a smooth transition between the chamfers. Different cutting edges are thus formed. The radial width of a chamfer is a projection length of the chamfer in a radial direction. A radial cross-section of the diamond composite in this embodiment is circular. Different chamfers satisfy one of the following conditions: different types of chamfers, the chamfer types at least including: single-bevel chamfer, double-bevel chamfer, or curved chamfer; and a same type of chamfers but with different structural parameters, the structural parameters including dimensions and angles.

Figure 3:
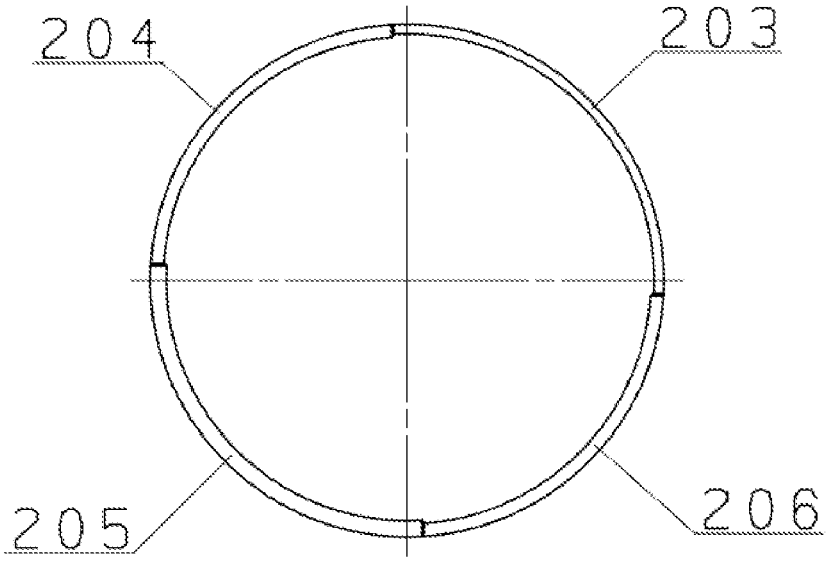
FIGS. 3 and 4 are a top view and a front view, respectively, of embodiment II of the present disclosure.
Figure 4:
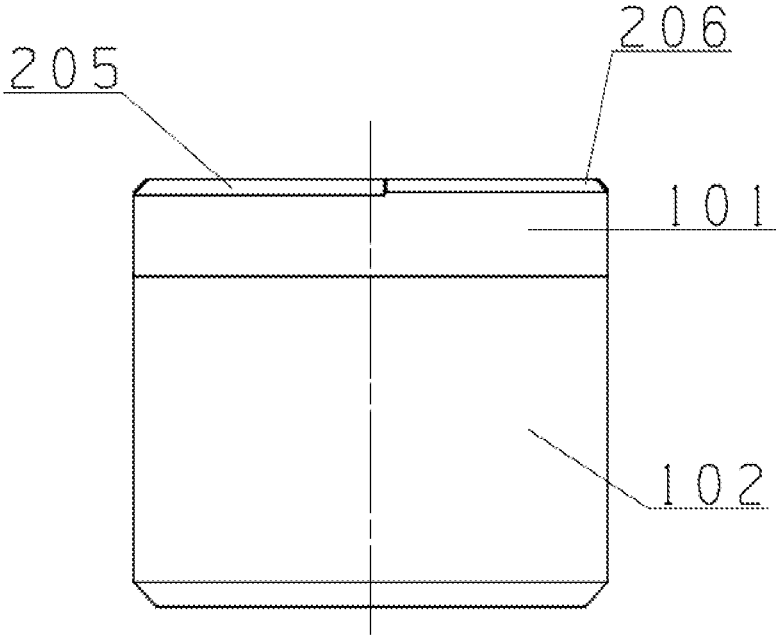

Embodiment II, as shown in FIGS. 3 to 4, differs from embodiment I in that three kinds of different chamfers are provided, including 4 chamfers, wherein 2 segments of chamfers 204, 206 are same, 45° single-bevel chamfers with a radial width of 0.4 mm and are spaced 90° apart and in symmetrical distribution, another chamfer 203 is a 45° single-bevel chamfer with a radial width of 0.3 mm, and a left-front chamfer 205 is a 45° single-bevel chamfer with a radial width of 0.5 mm. Other structures are same as in Embodiment I.

Figure 5:
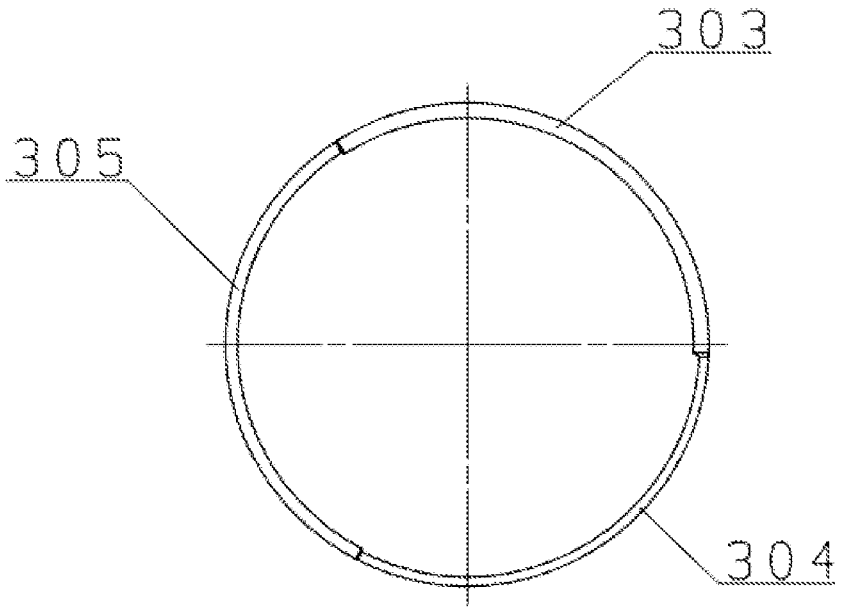
FIGS. 5 and 6 are a top view and a front view, respectively, of embodiment III of the present disclosure.
Figure 6:
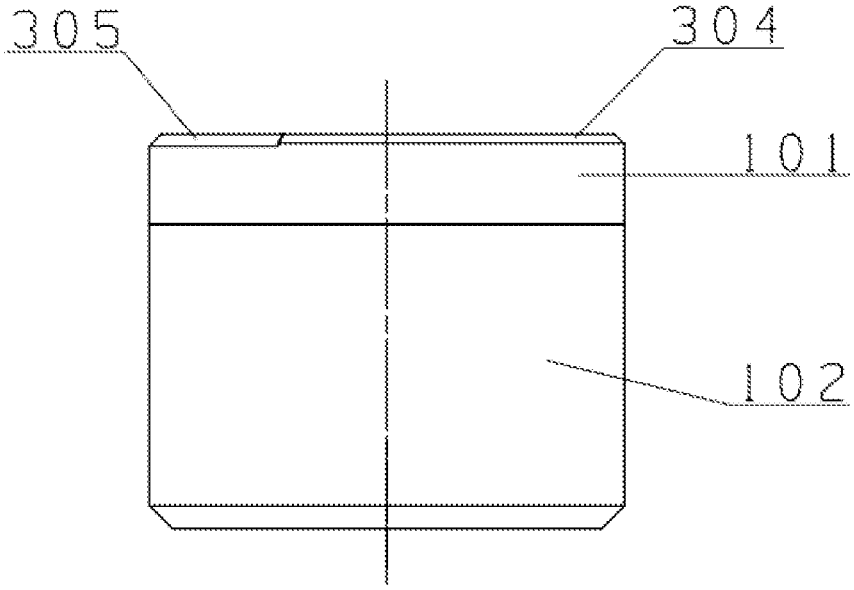

In Embodiment III, as shown in FIGS. 5 to 6, there are provided 3 segments of chamfers, each segment of chamfer corresponding to a central angle of 120°, evenly distributed circumferentially. The 3 segments of chamfers are three kinds of different chamfers, wherein one segment of chamfer 303 is a 45° single-bevel chamfer with a radial width of 0.5 mm, another chamfer 304 is a 45° single-bevel chamfer with a radial width of 0.3 mm, and a third segment of chamfer 305 is a 45° single-bevel chamfer with a radial width of 0.4 mm. The 3 segments of chamfers are arranged circumferentially and connected end to end. Other structures are same as in Embodiment I. In addition, the 3 segments of chamfers may also be unevenly distributed.

Figure 7:
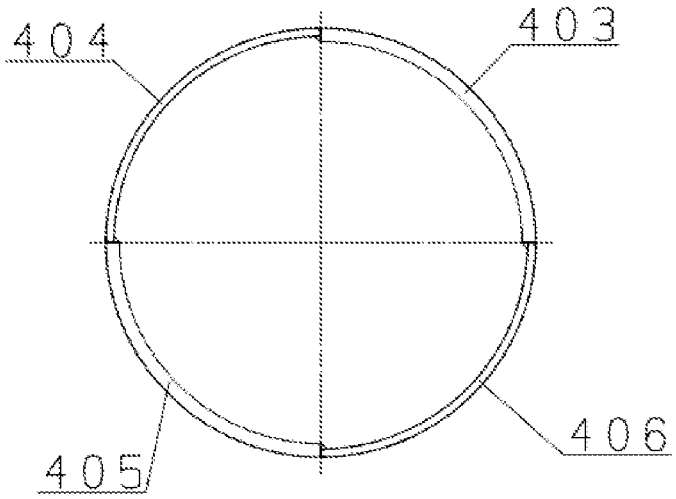
FIGS. 7 and 8 are a top view and a front view, respectively, of embodiment IV of the present disclosure.
Figure 8:
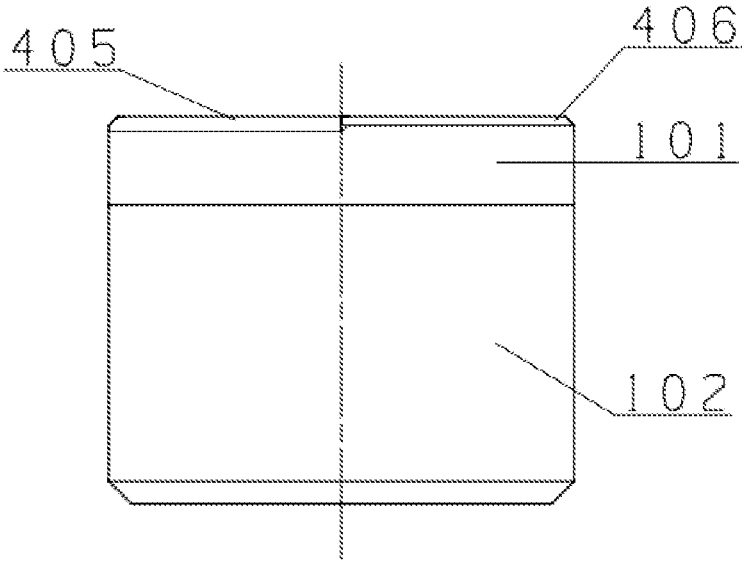

Embodiment IV, as shown in FIGS. 7 to 8, differs from embodiment I in that 2 segments of chamfers 403, 405 are same, 45° single-bevel chamfers with a radial width of 0.5 mm, and the other 2 segments of chamfers 404, 406 are same, for example, arc chamfers with a radius of curvature of 0.5 mm. Optionally, the 2 segments of chamfers 404, 406 may also have different radii of curvature. Other structures are same as in Embodiment I.

Figure 9:
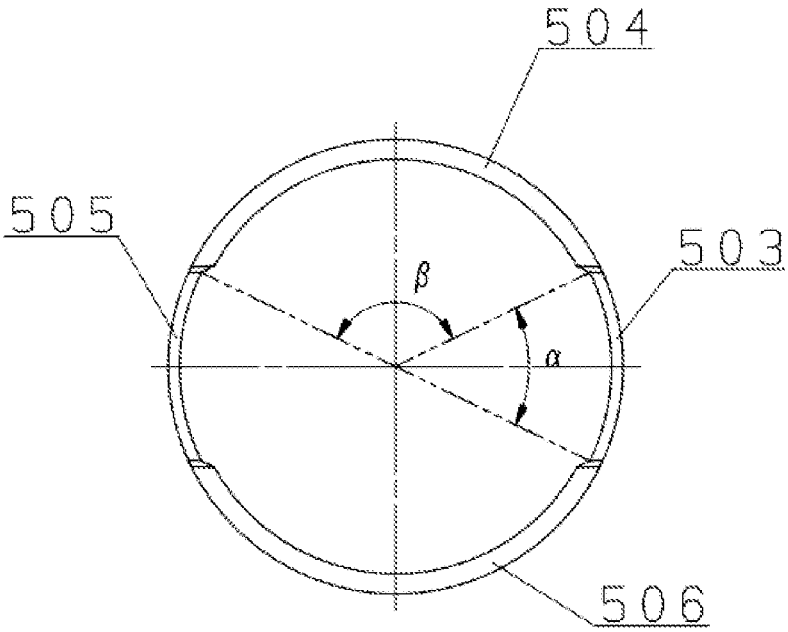
FIGS. 9 and 10 are a top view and a front view, respectively, of embodiment V of the present disclosure.
Figure 10:
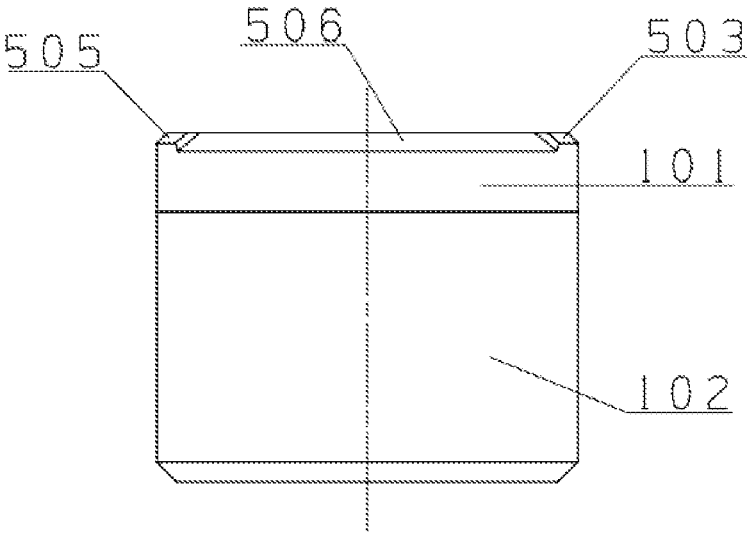

Embodiment V, as shown in FIGS. 9 to 10, differs from Embodiment I in that 2 symmetrically distributed chamfers 503, 505 are same, 45° single-bevel chamfers with a radial width of 0.3 mm, the 2 segments of chamfers corresponding to same central angles $\alpha=52°$; and the other 2 symmetrically distributed chamfers 504, 506 are same, 45° single-bevel chamfers with a radial width of 0.5 mm, the 2 segments of chamfers corresponding to same central angles $\beta=128°$.

Figure 11:
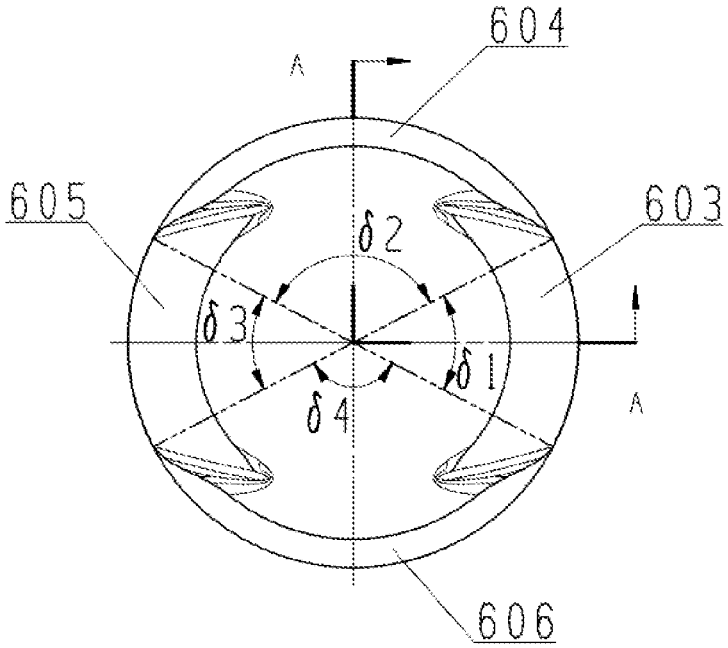
FIGS. 11 to 12 are a top view and an A-A sectional view, respectively, of embodiment VI of the present disclosure.
Figure 12:
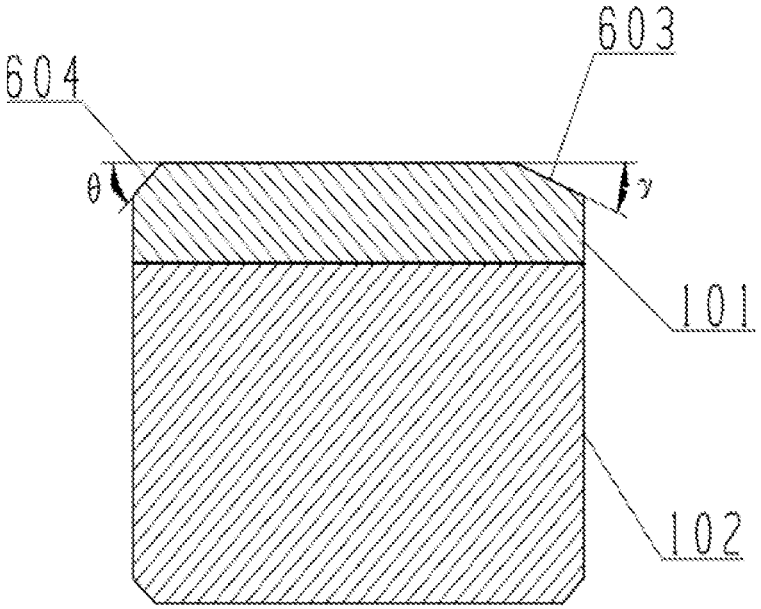

Embodiment VI, as shown in FIGS. 11 to 12, differs from Embodiment V in that 2 symmetrically distributed chamfers 603, 605 are same, single-bevel chamfers with a radial width of 2.4 mm, with an included angle between each single-bevel chamfer and a radial plane of the diamond composite layer being $\gamma=22.5°$, the 2 segments of chamfers corresponding to same central angles ($\delta1=\delta3=52°$); and the other 2 symmetrically distributed chamfers 604, 606 are same, single-bevel chamfers ($\theta=45°$ with a radial width of 1 mm, the 2 segments of chamfers corresponding to same central angle ($\delta2=\delta4=128°$). Other structures are same as in Embodiment V.

Figure 13:
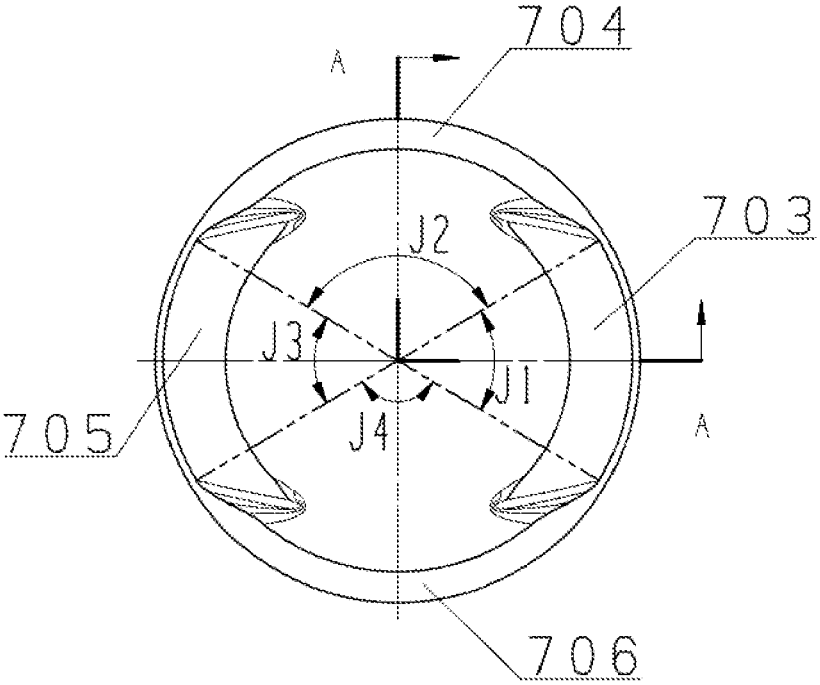
FIGS. 13 to 14 are a top view and an A-A sectional view, respectively, of embodiment VII of the present disclosure.
Figure 14:
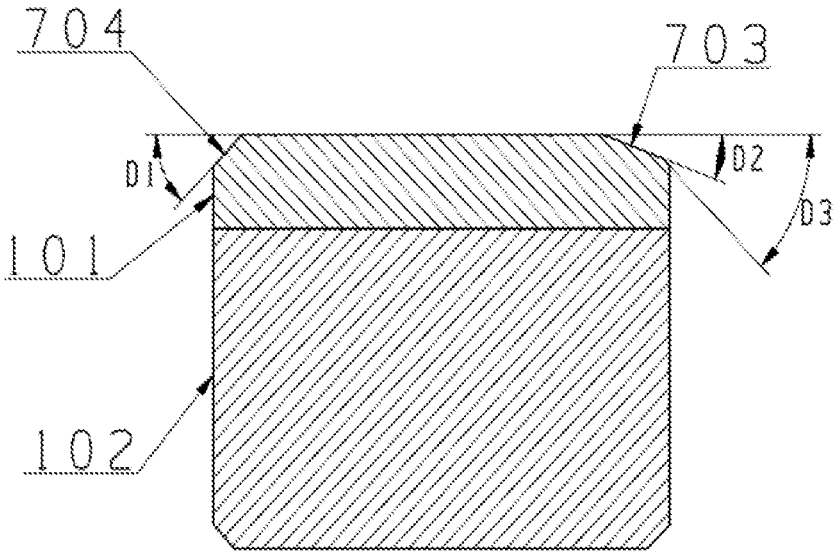

Embodiment VII, as shown in FIGS. 13 to 14, differs from Embodiment VI in that 2 correspondingly distributed chamfers 703 and 705 are same, double-bevel chamfers, and are each a combination of a D2 inner-bevel chamfer with a radial width of 2.3 mm and a D3 outer-bevel chamfer with a radial width of 0.3 mm, with an included angle between the inner-bevel chamfer and a radial plane of the diamond composite layer being D2=20°, and an included angle between the outer-bevel chamfer and the radial plane of the diamond composite layer being D3=45°, the 2 segments of chamfers corresponding to same central angles (J1=J3=52°); and the other 2 correspondingly distributed chamfers 704, 706 are same, bevel chamfers (D1=45°) with a radial width of 1 mm, the 2 segments of chamfers corresponding to same central angles (J2=J4=128°). Other structures are same as in Embodiment VI.

In some embodiments of the present disclosure, two segments of chamfers arranged spaced apart circumferentially around the top edge may be different. For example, the four segments of chamfers in embodiments I, II and IV to VII may be different, i.e., the 4 segments of chamfers differ in chamfer type or structural parameters.

The present disclosure also provides an earth-boring tool, such as a drill bit for drilling oil wells, including the above-described multi-cutting-edge diamond composite.

Finally, it should be noted that the above embodiments are only used for describing rather than limiting the technical solutions of the present disclosure. Although the present disclosure is described in detail with reference to the preferred embodiments, those of ordinary skill in the art should understand that they still can make modifications to the specific implementations in the present disclosure or make equivalent substitutions to part of technical features thereof; and such modifications and equivalent substitutions should be encompassed within the technical solutions sought for protection in the present disclosure.

The invention claimed is:

1. A multi-cutting-edge diamond composite, comprising a columnar hard alloy substrate and a diamond composite layer, the diamond composite layer being disposed at a top end of the hard alloy substrate, wherein a circumferential edge of a top end of the diamond composite layer is provided with at least two segments of different chamfers to form different cutting edges; and wherein the entire circumferential edge of the top end of the diamond composite layer is provided with chamfers, and for every two segments of different chamfers, the greater the radial width of the chamfer, the smaller an included angle between a bevel face of the chamfer and the radial plane of the diamond composite layer.

2. The multi-cutting-edge diamond composite according to claim 1, wherein the circumferential edge of the top end of the diamond composite layer is provided with 2 to 4 segments of different chamfers to form 2 to 4 segments of different cutting edges.

3. The multi-cutting-edge diamond composite according to claim 1, wherein the chamfers comprise at least one of the following types: single-bevel chamfer, double-bevel chamfer, or curved chamfer.

4. The multi-cutting-edge diamond composite according to claim 3, wherein types of two segments of different chamfers are different, or two segments of different chamfers are of the same type and have different structural parameters.

5. The multi-cutting-edge diamond composite according to claim 1, wherein a bevel face of each chamfer is inclined relative to a radial plane of the diamond composite layer at an angle in the range from 20° to 70°, and a top end face of the diamond composite layer is perpendicular to an axis of the columnar hard alloy substrate.

6. The multi-cutting-edge diamond composite according to claim 1, wherein each chamfer has a radial width of 0.2 to 5 mm.

7. The multi-cutting-edge diamond composite according to claim 1, wherein the top end face of the diamond composite layer is planar, inwardly concave or outwardly convex.

8. The multi-cutting-edge diamond composite according to claim 1, wherein a transverse cross-section of the diamond composite layer is same as that of the hard alloy substrate, both being circular, elliptical, or regular polygonal.

9. The multi-cutting-edge diamond composite according to claim 1, wherein the diamond composite layer is a polycrystalline diamond composite layer or a thermally stable polycrystalline diamond composite layer.

10. The multi-cutting-edge diamond composite according to claim 1, wherein the circumferential edge of the top end of the diamond composite layer is divided into four segments of different chamfers, wherein two chamfers that are spaced apart have same central angles.

11. The multi-cutting-edge diamond composite according to claim 10, wherein the central angles are 52° and 128°, or 90°.

12. The multi-cutting-edge diamond composite according to claim 1, wherein the circumferential edge of the top end of the diamond composite layer is divided into three segments of different chamfers, and central angles of the three chamfers are 120°.

13. An earth-boring tool, comprising a multi-cutting-edge diamond composite of claim 1.

* * * * *